US006130031A

United States Patent [19]

Merkel et al.

[11] Patent Number: 6,130,031

[45] **Date of Patent: *Oct. 10, 2000**

[54] PHOTOGRAPHIC ELEMENT CONTAINING A BENZOLYLACETANILIDE DIR COUPLER

[75] Inventors: Paul B. Merkel, Victor; Jerrold N. Poslusny, Rochester; David A. Steele, Webster, all of N.Y.

[73] Assignee: Eastman Kodak Company, Rochester, N.Y.

[ * ] Notice: This patent is subject to a terminal disclaimer.

[21] Appl. No.: 09/209,804

[22] Filed: Dec. 11, 1998

[51] Int. Cl.[7] ..... G03C 1/08; G03C 7/26; G03C 7/32

[52] U.S. Cl. ..... 430/544; 430/505; 430/557; 430/955; 430/957

[58] Field of Search ..... 430/505, 543, 430/544, 557, 955, 957

[56] References Cited

U.S. PATENT DOCUMENTS

Re. 29,379 8/1977 Shiba et al. .

FOREIGN PATENT DOCUMENTS 0 320 939 6/1989 European Pat. Off. .
0 867 763 A1 9/1998 European Pat. Off. .
04/278942 10/1992 Japan .

*Primary Examiner*—Geraldine Letscher
*Attorney, Agent, or Firm*—Edith A. Rice

[57] ABSTRACT

This invention comprises a photographic element, comprising a support bearing at least one silver halide emulsion and at least one benzoylacetanilide yellow dye-forming DIR coupler of structure I, below:

I wherein:

each $R_1$ is individually selected from the group consisting of halogen atoms and alkyl and alkoxy groups;

m is 0, 1, 2 or 3;

$R_2$ is selected from the group consisting of halogen atoms and alkoxycarbonyl, aryloxycarbonyl, carbonamido, sulfonamido, sulfamoyl, alkylsulfonyl, arylsulfonyl, sulfonyloxy, acyloxy and cyano groups and each is in the para position or in either meta position relative to the NH group of the anilide;

X is a hydrogen or halogen atom or an alkyl or alkoxy group;

$R_3$ is a halogen atom or an alkyl group and may be in the para position or either meta position relative to the NH group of the anilide;

n is 0 or 1; and $R_4$ is an alkyl group with 3 to 10 carbon atoms or a phenyl group.

17 Claims, No Drawings

PHOTOGRAPHIC ELEMENT CONTAINING A BENZOLYLACETANILIDE DIR COUPLER

FIELD OF THE INVENTION

This invention relates to a photographic element comprising a support bearing at least one silver halide emulsion and at least one benzoylacetanilide yellow dye-forming DIR coupler having a purine-type coupling off group.

BACKGROUND OF THE INVENTION

In a silver halide color photographic element or material, a color image is formed when the element is given an imagewise exposure to light and then subjected to a color development process. In the color development process silver halide is reduced to silver as a function of exposure by a color developing agent, which is oxidized and then reacts with coupler to form dye. In most color photographic elements the coupler or couplers are coated in the element in the form of small dispersion droplets. Many photographic elements or materials contain, in addition to imaging couplers, image-modifying couplers that release a photographically useful group from the coupling site upon reaction with oxidized color developer. Couplers that release a silver development inhibitor from the coupling-off position, so-called DIR couplers, are one type of image-modifying coupler commonly utilized in color photographic elements.

Many photographic materials, and especially color negative films, contain DIR (Development Inhibitor Releasing) couplers. In addition to forming imaging dye, DIR couplers, release inhibitors that can restrain silver development in the layer in which inhibitor release occurs as well as in other layers of a multilayer color photographic material. DIR couplers can help control gamma or contrast, can enhance sharpness or acutance, can reduce granularity, and can provide color correction via interlayer interimage effects.

Purine-releasing DIR couplers are generically disclosed in Japanese Patent application JP04/278942 A and in U.S. Pat. Re. No. 29,397 and in copending, commonly-assigned U.S. patent application Ser. No. 08/824,223 filed Mar. 25, 1997. However, neither the benzoylacetanilide DIR couplers of the present invention nor their advantages are specifically disclosed in these references.

PROBLEM TO BE SOLVED BY THE INVENTION

There has been a need for DIR couplers that more efficiently inhibit silver development. Yellow dye-forming DIR couplers that more efficiently provide gamma reductions are especially desirable. Yellow dye-forming DIR couplers that efficiently provide gamma reductions in other color records and thereby efficiently produce interlayer interimage effects are needed for improved color correction in multilayer color negative films. In addition, it is desirable that such DIR couplers have high activity to minimize required laydowns. Further, it is desired that the inhibitors released from DIR couplers are readily hydrolyzed to weak inhibitors in the color developer solution to prevent seasoning of the developer on extended use. It is also desirable that DIR couplers show low continued coupling when films containing them are placed in a bleach solution immediately after development (i.e. without an intervening stop bath). In addition to possessing all of these photographic properties, a useful DIR coupler must be readily synthesized and purified. For ease in manufacturing and purification it is highly desirable that a DIR coupler be a crystalline solid.

The yellow dye-forming DIR couplers of this invention provide crystalline compounds that possess all of the desired features noted above, particularly the ability efficiently to provide gamma reductions and interlayer color correction.

SUMMARY OF THE INVENTION

This invention provides a photographic element, comprising a support bearing at least one silver halide emulsion and at least one benzoylacetanilide yellow dye-forming DIR coupler of structure I, below:

I

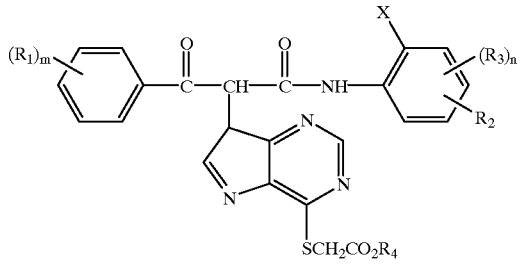

wherein:

each $R_1$ is individually selected from the group consisting of halogen atoms and alkyl and alkoxy groups;

m is 0, 1, 2 or 3;

$R_2$ is selected from the group consisting of halogen atoms and alkoxycarbonyl, aryloxycarbonyl, carbonamido, sulfonamido, sulfamoyl, alkylsulfonyl, arylsulfonyl, sulfonyloxy, acyloxy and cyano groups and each is in the para position or in either meta position relative to the NH group of the anilide;

X is a hydrogen or halogen atom or an alkyl or alkoxy group;

$R_3$ is a halogen atom or an alkyl group and may be in the para position or either meta position relative to the NH group of the anilide;

n is 0 or 1; and $R_4$ is an alkyl group with 3 to 10 carbon atoms or a phenyl group.

ADVANTAGEOUS EFFECT OF THE INVENTION

The invention provides a photographic element comprising a yellow dye-forming DIR coupler that is highly reactive and provides improved development inhibition and more efficient intralayer and interlayer gamma reductions. Furthermore, the benzoylacetanilide DIR couplers of the present invention possess a strong tendency to form readily-purified crystalline solids.

DETAILED DESCRIPTION OF THE INVENTION

This invention provides a photographic element, comprising a support bearing at least one silver halide emulsion and at least one benzoylacetanilide yellow dye-forming DIR coupler of structure I, below:

I

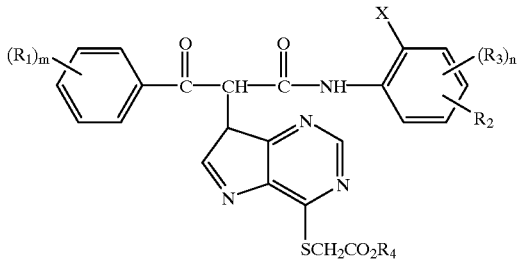

wherein:

each R1 is individually selected from the group consisting of halogen atoms and alkyl and alkoxy groups;

m is 0, 1, 2 or 3;

$R_2$ is selected from the group consisting of halogen atoms and alkoxycarbonyl, aryloxycarbonyl, carbonamido, sulfonamido, sulfamoyl, alkylsulfonyl, arylsulfonyl, sulfonyloxy, acyloxy and cyano groups and each is in the para position or in either meta position relative to the NH group of the anilide;

X is a hydrogen or halogen atom or an alkyl or alkoxy group;

$R_3$ is a halogen atom or an alkyl group and may be in the para position or either meta position relative to the NH group of the anilide;

n is 0 or 1; and $R_4$ is an alkyl group with 3 to 10 carbon atoms or a phenyl group.

In a preferred embodiment, the total number of carbon atoms in all of the $R_1$, $R_2$, $R_3$ and X taken together is at least 6 and, more preferably, at least 8. This can facilitate dissolution of the coupler in dispersion droplets and can minimize coupler and dye wandering. In a useful embodiment X is a halogen atom, such as chlorine of fluorine. In a further useful embodiment, m is 1 or 2, and $R_1$ is an alkoxy group. In another useful embodiment $R_2$ is an alkoxycarbonyl group, preferably in the position para to X. In a particularly preferred embodiment $R_4$ contains 3 to 6 carbon atoms.

In a preferred embodiment, one or more benzoylacetanilide DIR couplers of this invention is coated in the same layer with at least one blue-sensitive silver halide emulsion in the photographic elements of this invention. Use of the benzoylacetanilide DIR couplers of this invention in the same layer with at least one blue-sensitive tabular grain emulsion, as described below, is particularly contemplated. Use of the photographic elements of this invention in multilayer color negative films is especially contemplated In another useful embodiment, one or more benzoylacetanilide DIR couplers of this invention is coated in the same layer with at least one green-sensitive silver halide emulsion in the photographic elements of this invention. The high reactivities and high development inhibition efficiencies together with the relative low dye extinction coefficients of the DIR couplers of this invention allows their utilization at low levels in the green records of multilayer films without producing serious color contamination. Use of the benzoylacetanilide DIR couplers of this invention in the same layer with at least one green-sensitive tabular grain emulsion is also specifically contemplated.

The alkyl groups comprising $R_1$, $R_3$, $R_4$ and X may be straight-chain, branched or cyclic and may be unsubstituted or substituted. The alkoxy groups comprising $R_1$ and X may be unbranched or branched and may unsubstituted or substituted. The phenyl groups comprising $R_4$ may also be unsubstituted or substituted. The alkoxycarbonyl, aryloxycarbonyl, carbonamido, sulfonamido, sulfamoyl, alkylsulfonyl, arylsulfonyl, sulfonyloxy and acyloxy groups comprising $R_2$ may also be substituted. Any substituent may be chosen to further substitute the $R_1$, $R_2$, $R_3$, $R_4$ and X groups of this invention that does not adversely affect the performance of the benzoylacetanilide DIR couplers and photographic elements of this invention. Suitable substituents include halogen atoms, such as chlorine and fluorine, alkenyl groups, alkynyl groups, aryl groups, hydroxy groups, alkoxy groups, aryloxy groups, acyl groups, acyloxy groups, alkoxycarbonyl groups, aryloxycarbonyl groups, carbonamido groups (including alkyl-, aryl-, alkoxy-, aryloxy-, and alkylamino-carbonamido groups), carbamoyl groups, carbamoyloxy groups, sulfonamido groups, sulfamoyl groups, alkylthio groups, arylthio groups, sulfoxyl groups, sulfonyl groups, sulfonyloxy groups, alkoxysulfonyl groups, aryloxysulfonyl groups, trifluoromethyl groups, cyano groups, imido groups, and other heterocyclic groups, such as 2-furyl, 3-furyl, 2-thienyl, 1-pyrrolyl and 1-imidazolyl groups. The phenyl groups comprising $R_4$ may also be substituted with one or more unbranched, branched or cyclic alkyl groups.

Useful coated levels of the benzoylacetanilide DIR couplers of this invention range from about 0.004 to 0.60 $g/m^2$, or more typically from 0.010 to 0.25 $g/m^2$.

The yellow dye-forming benzoylacetanilide DIR couplers of this invention may be utilized by dissolving them in high-boiling coupler solvents and then dispersing the organic coupler plus coupler solvent mixtures as small particles in aqueous solutions of gelatin and surfactant (via milling or homogenization). Removable auxiliary organic solvents, such as ethyl acetate or cyclohexanone, may also be used in the preparation of such dispersions to facilitate the dissolution of the coupler in the organic phase. Coupler solvents useful for the practice of this invention include aryl phosphates (e.g. tritolyl phosphate), alkyl phosphates (e.g. tri-2-ethylhexyl phosphate), mixed aryl alkyl phosphates (e.g. diphenyl 2-ethylhexyl phosphate), aryl, alkyl or mixed aryl alkyl phosphonates, phosphine oxides (e.g. trioctyl phosphine oxide), esters of aromatic acids (e.g. dibutyl phthalate, 2-ethylhexyl benzoate, 3-phenylpropyl benzoate, benzyl salicilate or 1,2-hexanediol dibenzoate), esters of aliphatic acids (e.g. acetyl tributyl citrate, dibutyl sebecate or tripentyl citrate), alcohols (e.g. oleyl alcohol or 2-hexyl-1-decanol), phenols (e.g. p-dodecylphenol), carbonamides (e.g. N,N-dibutyldodecanamide, N-butylacetanilide, or 1-dodecyl-2-pyrrolidinone), sulfoxides (e.g. bis(2-ethylhexyl)sulfoxide or dodecyl-2-ethylhexyl sulfoxide) sulfonamides (e.g. N,N-dibutyl-p-tolenesulfonamide) or hydrocarbons (e.g. dodecylbenzene). Additional high-boiling coupler solvents and auxiliary solvents are disclosed in Research Disclosure, December 1989, Item 308119, p993. Useful coupler:coupler solvent weight ratios range from about 1:0.1 to 1:8, with 1:0.3 to 1:2 being typical. The benzolacetanilide DIR couplers of this invention may also be dispersed and coated in latex particles or may be dispersed and coated without a coupler solvent or latex.

The photographic elements of this invention comprise yellow dye-forming DIR couplers that are highly reactive and that provide more efficient development inhibition and more efficient intralayer and interlayer gamma reductions. The surprisingly efficient gamma suppression provided by the photographic elements of this invention permits reductions in coated levels of DIR couplers and can yield enhanced color correction via more efficient interlayer interimage effects. Improved interlayer interimage is achieved because the DIR couplers of this invention can provide substantial reductions in gamma or contrast in receiver layers without producing excessive gamma reductions in the layer or layers in which they are coated (typically the blue or green records). In addition, the photographic elements of this invention comprise readily-manufacturable, crystalline yellow dye-forming DIR couplers. The benzoylacetanlide DIR couplers comprising the photographic elements of this invention are also relatively inexpensive and are readily dispersible. Furthermore the inhibitors released from the DIR couplers of this invention are readily hydrolyzed in developer solutions to yield noninhibitors or very weak inhibitors. This reduces or eliminates the undesirable sensitometric effects that can occur, if a strong inhibitor diffuses out of a photographic material and accumulates in color developer solution.

Examples of purine-releasing benzoylacetanilide DIR couplers of this invention include, but are not limited to, A1–A12, below:

A1

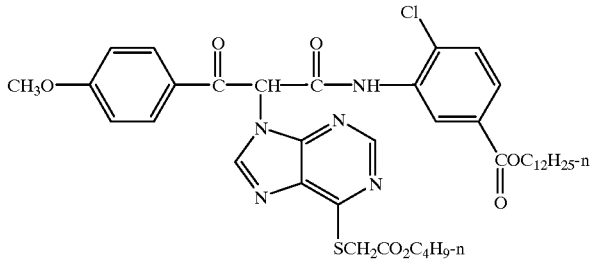

A2

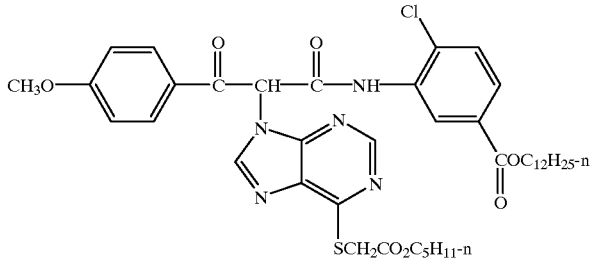

A3

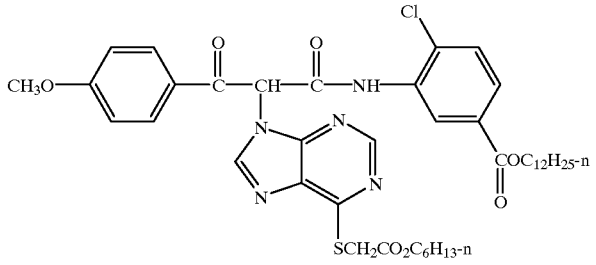

-continued
A4
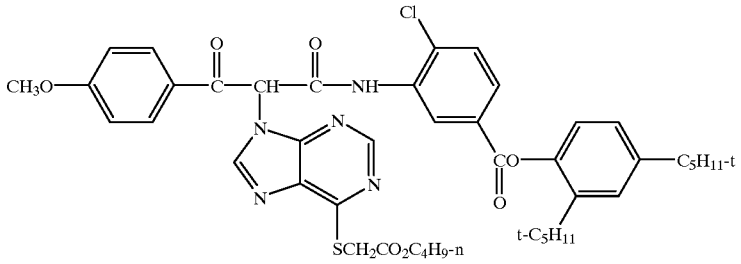
A5
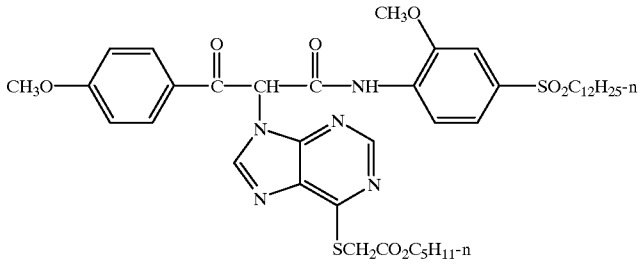
A6
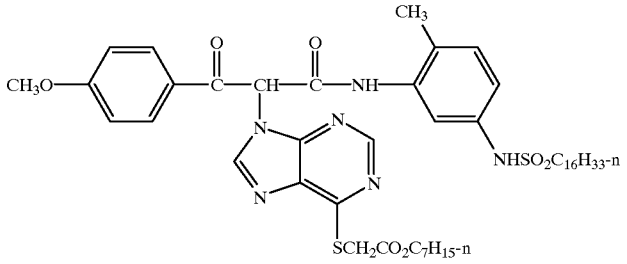
A7
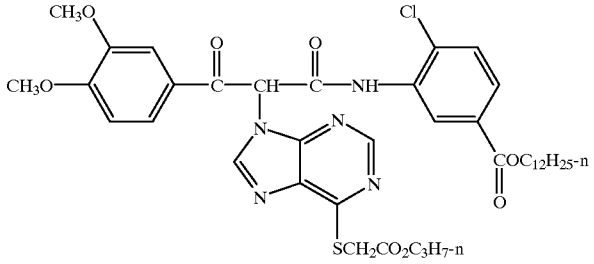

-continued
A8
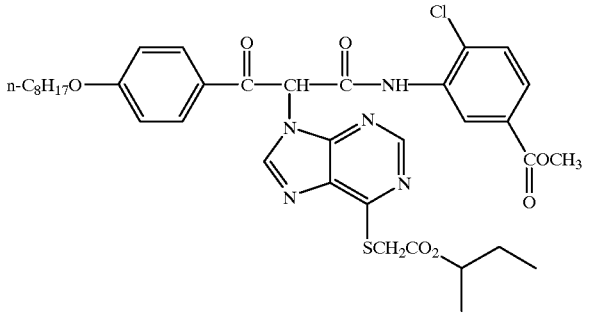
A9
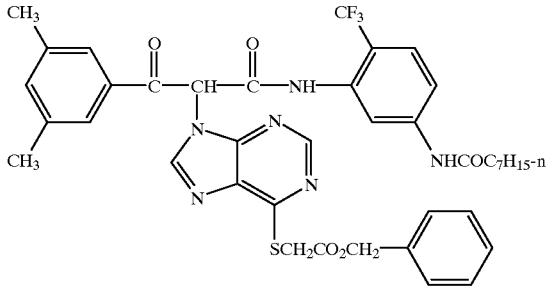
A10
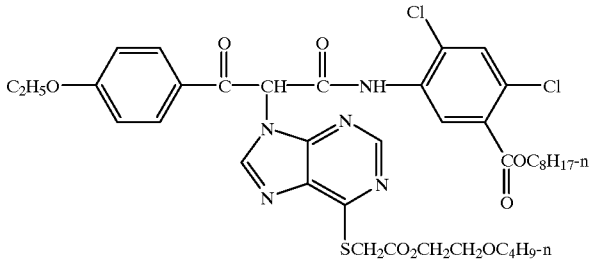
A11
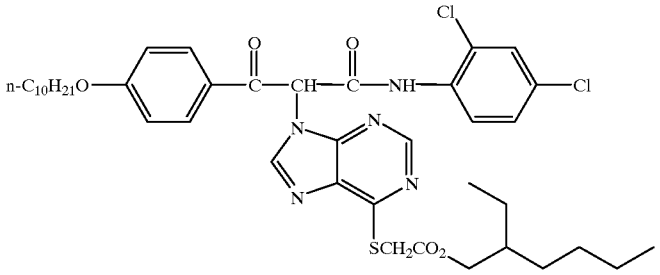
A12
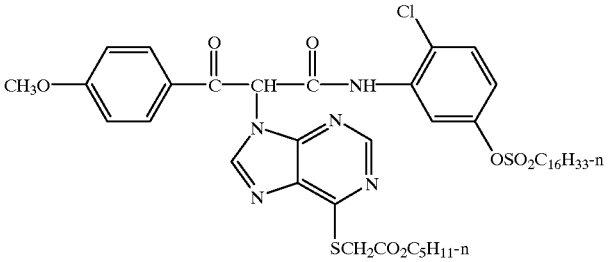

The couplers of this invention may be coated with a variety of other types of couplers in the same layer or in different layers of a multilayer photographic element. Specifically contemplated is the use of the benzoylacetanilide DIR couplers of this invention in blue light-sensitive photographic elements in the same layer with one or more yellow dye-forming imaging couplers, such as couplers Y-1 or Y-2, below, or in green light-sensitive photographic elements in the same layer as magenta dye-forming imaging couplers, such as M-1, below:

Y-1

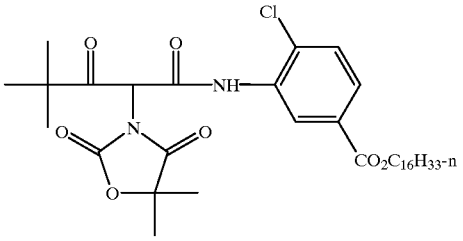

Y-2

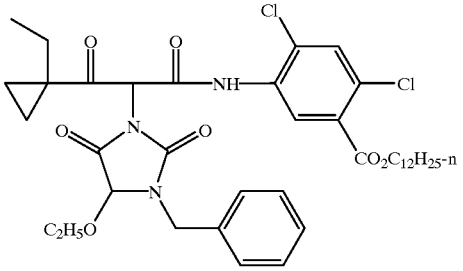

M-1

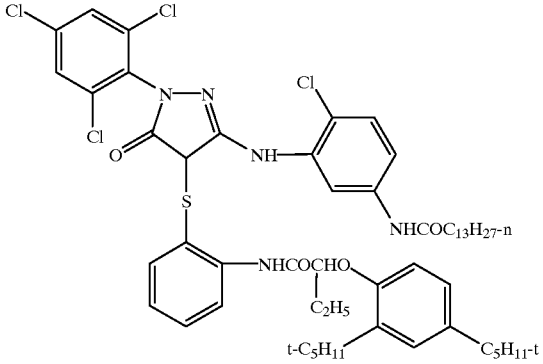

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1996, Number 389, Item 38957, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-1 13935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds which may be useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydispersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$)>25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultrathin (<0.07 $\mu$m) tabular grains being contemplated for maximum tabular grain performance enhancements. When the native blue absorption of iodohalide tabular grains is relied upon for blue speed, thicker tabular grains, typically up to 0.5 mm in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide grains to be used in the invention may be prepared according to methods known in the art, such as those described in *Research Disclosure I* and James, The Theory of the *Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc., at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure*, Item 38957, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure. To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process*, 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(b-(methanesulfonamido) ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

The following examples illustrate the invention.

EXAMPLE 1

Illustration of the Improved Development Inhibition Efficiency in the Photographic Elements of This Invention.

In this example, coupler A1 of this invention is compared to couplers C1 and C2 of the prior art, for which structures are given below. Comparative DIR couplers C1 and C2 correspond to specific couplers A31 and A24 in U.S. patent application Ser. No. 08/824,223. Neither of these couplers is a crystalline solid. Consequently, column chromatography is required to purify these glassy couplers, which is not practical for large scale manufacture. In contrast, coupler A1 of this invention, like most couplers of this invention, is a crystalline solid (MP=108° C.), which may be obtained in good purity without the need for chromatography.

C1

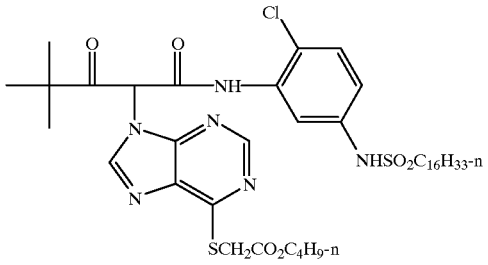

C2

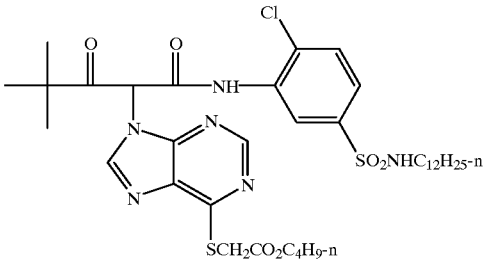

To illustrate the advantageous behavior of the photographic elements of this invention, couplers C1, C2 and A1 were evaluated in the multilayer causer/receiver format shown in Table I. Structures of components that were not given previously are provided after Table I. Component laydowns in g/m$^2$ are shown in Table I in parentheses. The DIR couplers were each coated a level of 0.065 mmole/m$^2$. Each DIR coupler was dispersed at a 1:1 weight ratio in dibutyl phthalate (S-2). The dispersions were prepared by adding an oil phase containing a 1:1:3 weight ratio of DIR coupler:S-2: ethyl acetate to an aqueous phase containing ALKANOL XC (mixed isomers of triisopropyl-2-naphthalene sulfonic acid sodium salt, DuPont) and gelatin in a 1:10 weight ratio. The mixture was then passed through a colloid mill to disperse the oil phase in the aqueous phase as small particles. On coating, the ethyl acetate auxiliary solvent evaporates. Coupler Y-1 was dispersed with tritolyl phosphate (S-1, mixed isomers) at a 1:0.5 weight ratio.

Film samples were given a sensitometric white light (neutral) exposure and processed in a KODAK FLEXICOLOR C-41 process as in Table II. Blue (causer) and green (receiver) status M densities vs. exposure were measured for check film A without DIR coupler and for the films containing comparative DIR couplers C1 and C2 and the DIR coupler of this invention A1. Blue and green gamma (γ) values were then obtained from slopes of plots of density vs. log exposure. It is desirable that a DIR coupler efficiently reduce gamma or contrast in the layer or color record in which it is coated to effectively provide benefits such as enhanced sharpness, reduced granularity and improved exposure latitude. For high interlayer interimage and high color correction it is desirable that a DIR coupler also efficiently produce gamma reductions in receiver layers without excessive gamma reduction in its own causer layer. In this case, blue gamma corresponds to causer gamma and green gamma to receiver gamma. Blue and green gamma values obtained from neutral exposures of processed films A–D are given in Table III.

From the data in Table III, it is apparent that coupler A1 of this invention provides greater reduction in blue gamma than comparative couplers C1 or C2 at equimolar laydowns. Thus, in addition to the advantage of being crystalline, A1 provides a photographic element in which, surprisingly, the DIR coupler can more efficiently produce the benefits of improved sharpness, reduced granularity and improved exposure latitude associated with gamma reduction in its own layer or record. Furthermore, coupler A1 of this invention also more efficiently produces green gamma reduction the receiver layer, which leads to more efficient color correction via interlayer interimage.

TABLE I

OVERCOAT: Gelatin (5.38)
Bis(vinylsulfonylmethyl) ether Hardener (0.281)
CAUSER: Y-1 (0.861) & S-1 (0.430)
and A) No DIR coupler (Uninhibited check)
or B) C1 (0.0530) & S-2 (0.0530) (Comparison)
or C) C2 (0.0494) & S-2 (0.0494) (Comparison)
or D) A1 (0.0504) & S-2 (0.0504) (Invention)
Green-Sens. 0.46 μm Silver Iodobromide Emulsion (0.807 Ag)
Gelatin (2.69)
INTERLAYER: IS-1 (0.054) & S-1 (0.054)
Gelatin (0.86)
RECEIVER: M-1 (0.430), S-1 (0.344) & ST-1 (0.086)
Red Sens. 0.46 μm Silver Iodobromide Emulsion (0.807 Ag)
Tetraazaindine (0.019)
Gelatin (2.69)
Cellulose Acetate Support with Gelatin U-Coat and Antihalation Backing

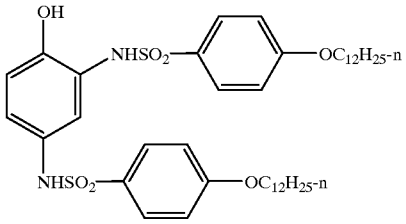

IS-1

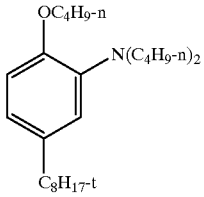

ST-1

TABLE II

C-41 Processing Solutions and Conditions

| Solution | Process Time | Agitation gas |
|---|---|---|
| C-41 Developer | 3'15" | Nitrogen |
| Stop Bath | 30" | Nitrogen |
| Wash | 2'00" | None |
| Bleach | 3'00" | Air |
| Wash | 3'00" | None |
| Fix | 4'00" | Nitrogen |
| Wash | 3'00" | None |
| Wetting Agent Bath | 30" | None |
| Process Temperature = 38° C. | | |

TABLE III

| Coating | DIR Coupler | Blue γ | Green γ |
|---|---|---|---|
| A | None | 1.75 | 1.39 |
| B | C1 (Comparison) | 1.07 | 0.93 |
| C | C2 (Comparison) | 1.10 | 0.96 |
| D | A1 (Invention) | 0.92 | 0.75 |

EXAMPLE 2

Additional Illustration of the Improved Performance of a Photographic Element of This Invention.

For this example, DIR coupler A1 of this invention and a photographic element containing it is compared to DIR coupler IR-1 of the prior art and a photographic element containing it. DIR coupler IR-1, whose structure is given below, is utilized in the blue records of commercial color negative films. The photographic elements in this example are very similar to those in Example 1 and are shown in Table IV. Again laydowns in g/m2 are given in parentheses. Both DIR couplers were coated at the same molar laydown of 0.065 mmole/$m^2$. Dispersions of IR-1 with S-1 (tritolyl phosphate, mixed isomers) and A1 with S-2 were prepared as in Example 1. Coatings E, F and G containing no DIR coupler, coupler IR-1 and coupler A1, respectively, were exposed, processed and analyzed as in Example 1. The resulting blue and green gamma values were measured and are given in Table V. While gamma values are reduced in all films containing the yellow dye-forming DIR couplers, surprisingly both blue and green gamma values are reduced to a much greater extent in photographic element G containing the DIR coupler of this invention. Thus, coupler A1 of this invention can more efficiently provide the intralayer sharpness, granularity and latitude benefits associated with gamma reductions in its own records as well as the color correction associated with gamma reduction in a receiver layers.

TABLE IV

OVERCOAT: Gelatin (5.38)
Bis(vinylsulfonylmethyl) ether Hardener (0.281)
CAUSER: Y-1 (0.861) & S-1 (0.430)
and E) No DIR coupler (Uninhibited check)
or F) IR-1 (0.049) & S-1 (0.025) (Comparison)
or G) A1 (0.050) & S-2 (0.050) (Invention)
Green-Sens. 0.46 μm Silver Iodobromide Emulsion (0.807 Ag)
Gelatin (2.69)
INTERLAYER: IS-1 (0.054) & S-1 (0.054), Gelatin (0.86)
RECEIVER: M-1 (0.430), S-1 (0.344) & ST-1 (0.086)
Red Sens. 0.46 μm Silver Iodobromide Emulsion (0.807 Ag)
Tetraazaindine (0.019), Gelatin (2.69)
Cellulose Acetate Support with Gelatin U-Coat and Antihalation Backing

IR-1

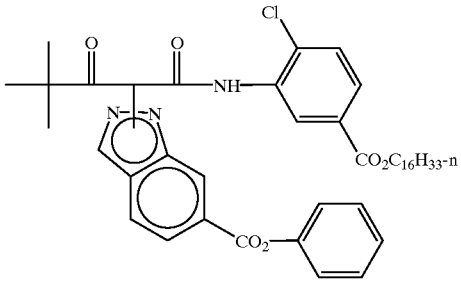

TABLE V

| Coating | DIR Coupler | Blue γ | Green γ |
|---|---|---|---|
| E | None | 1.72 | 1.48 |
| F | IR-1 (Comparison) | 1.43 | 1.25 |
| G | A1 (Invention) | 0.89 | 0.78 |

EXAMPLE 3

A Multilayer Color Negative Photographic Element of This Invention.

For this example, a multilayer color negative photographic element of this invention containing DIR coupler A1 of this invention was compared to a multilayer color negative photographic element containing the comparative DIR coupler IR-1 at a higher laydown. The multilayer film structures utilized in this comparison are illustrated in Table VI. Structures of compounds not provided previously are provided after Table VI. Component laydowns are provided in units of $g/m^2$ unless otherwise indicated. This comparison may also be coated on a support, such as polyethylene naphthalate, that contains a magnetic recording layer. The films in this example were given neutral exposures and processed using Kodak FLEXICOLOR C-41 processing chemistry. Results are compared below.

Blue gamma values are well matched for films H and I even though a lower molar laydown (about 50% of IR-1 laydown) of coupler A1 was used for I. Upper scale red and green gamma values are reduced somewhat for film I relative to film H, indicating a desirable increase in interlayer interimage in film I containing DIR coupler A1 of this invention, in spite of the much reduced laydown of A1 relative to IR-1.

TABLE VI

| MULTILAYER FILM STRUCTURE | |
|---|---|
| 1 Overcoat & UV Layer: | Matte Bead<br>UV Absorbers UV-1 (0.108), UV-2 (0.108) & S-1 (0.151)<br>Silver Bromide Lippmann Emulsion (0.215 Ag)<br>Gelatin (1.237)<br>Bis(vinylsulfonyl)methane Hardener (1.75% of Total Gelatin) |
| 2 Fast Yellow Layer: | Y-1(0.236) Yellow Dye-Forming Coupler & S-1 (0.151)<br>H IR-1 (0.076) DIR Coupler (Comparison) & S-1 (0.038)<br>or I A1 (0.038) DIR Coupler (Invention) & S-2 (0.038)<br>B-1 (0.0054) BARC & S-3 (0.0070)<br>Blue Sensitive Silver Iodobromide Emulsion (0.377 Ag),<br>4.1 mole % Iodide T-Grain (2.9 × 0.12 μm)<br>Blue Sensitive Silver Iodobromide Emulsion (0.108 Ag)<br>4.1 mole % Iodide T-Grain (1.9 × 0.14 μm)<br>Gelatin (0.807) |
| 3 Slow Yellow Layer: | Y-1 (1.076) & S-1 (0.538)<br>H IR-1 (0.076) & S-1 (0.076)<br>or I A1 (0.038) & S-2 (0.038)<br>B-1 (0.022) & S-3 (0.0028)<br>CC-1 (0.032) & S-2 (0.064)<br>IR-4 (0.032) & S-2 (0.064)<br>Blue Sensitive Silver Iodobromide Emulsion (0.398 Ag),<br>4.1 mole % Iodide T-Grain (1.9 × 0.14 μm)<br>Blue Sensitive Silver Iodobromide Emulsion (0.269 Ag),<br>1.3 mole % Iodide T-Grain (0.54 × 0.08 μm)<br>Blue Sensitive Silver Iodobromide Emulsion (0.247 Ag)<br>1.5 mole % Iodide T-Grain (0.77 × 0.14 μm)<br>Gelatin (1.872) |
| 4 Yellow Filter Layer: | R-1 (0.086) & S-2 (0.139) & ST-2 (0.012)<br>YD-2 Filter Dye (0.054)<br>Gelatin (0.646) |
| 5 Fast Magenta Layer: | M-1(0.075) Magenta Dye-Forming Coupler & S-1 (0.068)<br>& ST-1 (0.0075), Addendum, R-2 (0.009) |

TABLE VI-continued

| MULTILAYER FILM STRUCTURE | |
|---|---|
| | MM-1 (0.054) Masking Coupler & S-1 (0.108) |
| | IR-3 (0.030) DIR Coupler & S-2 (0.060) |
| | B-1 (0.003) & S-3 (0.004) |
| | Green Sensitive Silver Iodobromide Emulsion (0.484 Ag), |
| | 4.0 mole % Iodide T-Grain (1.60 × 0.12 μm) |
| | Gelatin (1.014) |
| 6 Mid Magenta | M-1 (0.124) & S-1 (0.111) & ST-1 (0.012) |
| Layer: | MM-1 (0.118) & S-1 (0.236), R-2 (0.015) |
| | A2 (0.026) DIR Coupler & S-2 (0.026) |
| | Green Sensitive Silver Iodobromide Emulsion (0.247 Ag), |
| | 4.0 mole % Iodide T-Grain (1.20 × 0.11 μm) |
| | Green Sensitive Silver Iodibromide Emulsion (0.247 Ag) |
| | 4.0 mole % Iodide T-Grain (1.00 × 0.12 μm) |
| | Gelatin (1.216) |
| 7 Slow Magenta | M-1 (0.269) & S-1 (0.242) & ST-1 (0.027) |
| Layer: | MM-1 (0.086) & S-1 (0.172) |
| | A2 (0.007) & S-2 (0.007) |
| | Green Sensitive Silver Iodobromide Emulsion (0.344 Ag), |
| | 3.5 mole % Iodide T-Grain (0.90 × 0.12 μm) |
| | Green Sensitive Silver Iodobromide Emulsion (0.129 Ag), |
| | 1.5 mole % Iodide T-Grain (0.50 × 0.08 μm) |
| | Gelatin (1.076) |
| 8 Interlayer: | R-1 (0.086) Interlayer Scavenger, S-2 (0.139) |
| | & ST-2 (0.012) |
| | Gelatin (0.538) |
| 9 Fast Cyan | CC-1 (0.183) Cyan Dye-Forming Coupler & S-2 (0.210) |
| Layer: | CM-1 (0.022) Masking Coupler |
| | IR-4 (0.027) DIAR Coupler & S-2 (0.054) |
| | Red Sensitive Silver Iodobromide Emulsion (0.592 Ag), |
| | 4.1 mole % Iodide T-Grain (1.7 × 0.12 μm) |
| | Gelatin (0.915) |
| 10 Mid Cyan | CC-1 (0.170) & S-2 (0.190) |
| Layer: | CM-1 (0.032) |
| | B-1 (0.008) & S-3 (0.010) |
| | IR-4 (0.019) & S-2 (0.038) |
| | Red Sensitive Silver Iodobromide Emulsion (0.194 Ag), |
| | 4.1 mole % Iodide T-Grain (1.2 × 0.11 μm) |
| | Red Sensitive Silver Iodobromide Emulsion (0.236 Ag), |
| | 4.1 mole % Iodide T-Grain (0.91 × 0.1 1 μm) |
| | Gelatin (1.076) |
| 11 Slow Cyan | CC-1 (0.533) & S-2 (0.560) |
| Layer: | IR-4 (0.026) & S-2 (0.052) |
| | CM-1 (0.031) |
| | B-1 (0.056) & S-3 (0.073) |
| | Red Sensitive Silver Iodobromide Emulsion (0.463 Ag), |
| | 1.5 mole % Iodide T-Grain (0.54 × 0.06 μm) |
| | Red Sensitive Silver Iodobromide Emulsion (0.301 Ag) |
| | 4.1 mole % Iodide T-Grain (0.53 × 0.12 μm) |
| | Gelatin (1.679) |
| 12 Antihalation | Gray Silver (0.135) |
| Layer: | UV-1 (0.075), UV-2 (0.030), S-1 (0.042) S-4 (0.015) |
| | YD-1 (0.034), MD-1 (0.018) & S-5 (0.018) |
| | CD-1 (0.025) & S-2 (0.125) |
| | R-1 (0.161), S-2 (0.261) & ST-2 (0.022) |
| | Gelatin (2.04) |
| Cellulose Triacetate Support | |

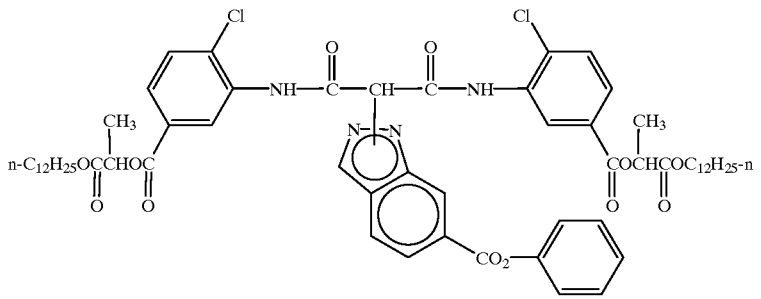

IR-2

TABLE VI-continued
| MULTILAYER FILM STRUCTURE | |
|---|---|
| 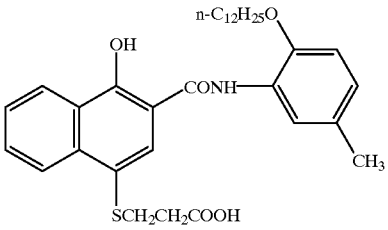 | B-1 |
| 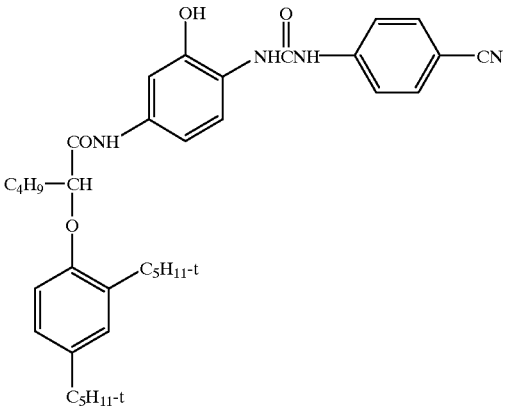 | CC-1 |
| 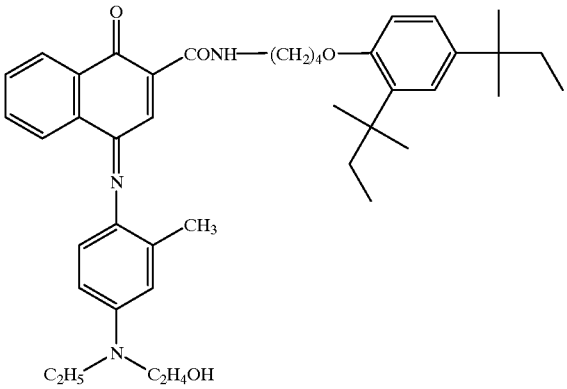 | CD-1 |
| 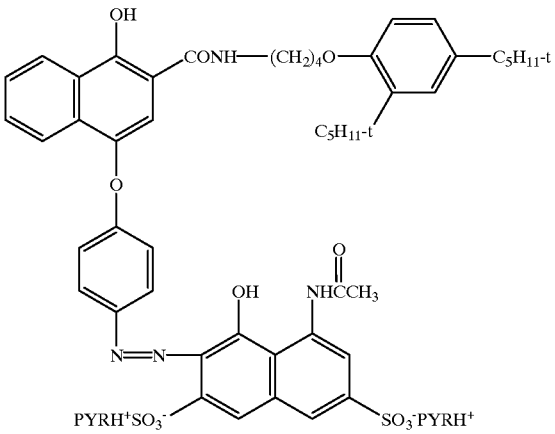 | CM-1 |

TABLE VI-continued
| MULTILAYER FILM STRUCTURE | |
|---|---|
| 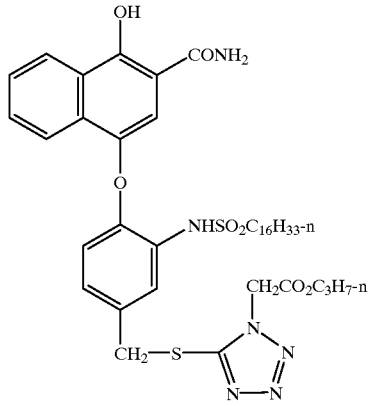 | IR-3 |
| 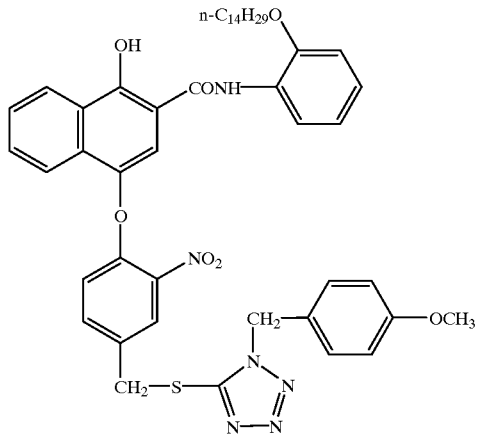 | IR-4 |
| 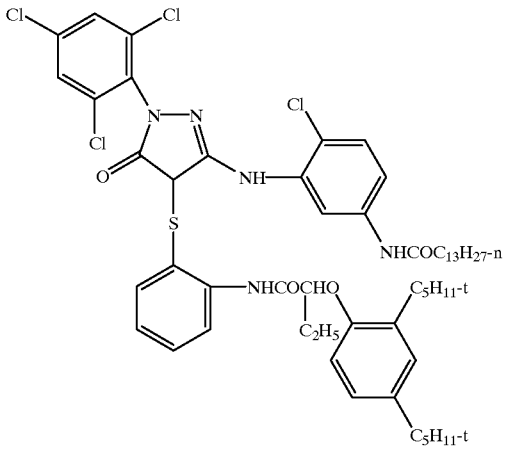 | M-1 |

TABLE VI-continued
| MULTILAYER FILM STRUCTURE | |
|---|---|
| 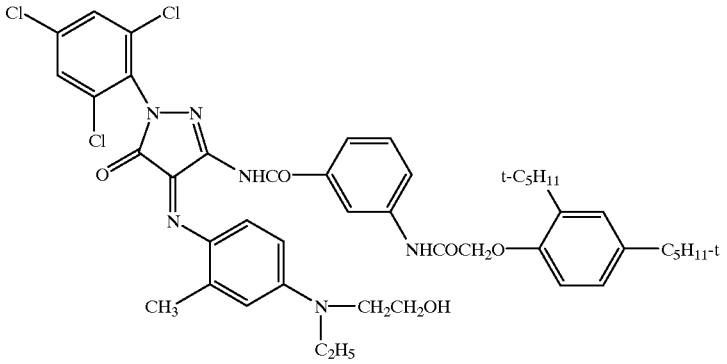 | MD-1 |
| 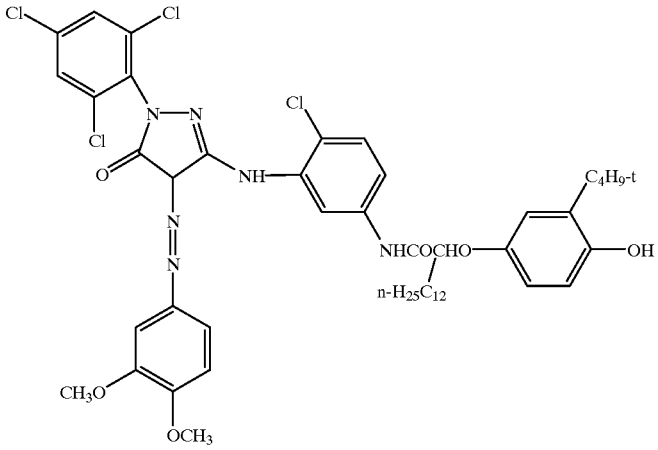 | MM-1 |
| 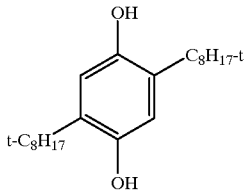 | R-1 |
| 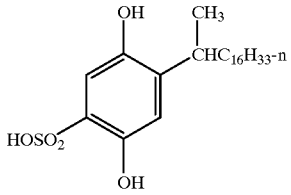 | R-2 |
| 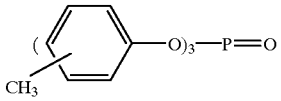 mixed isomers | S-1 |
| 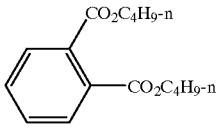 | S-2 |

TABLE VI-continued
| MULTILAYER FILM STRUCTURE | |
|---|---|
| 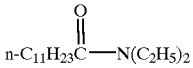 | S-3 |
| 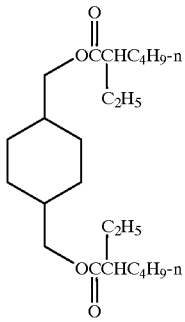 | S-4 |
| 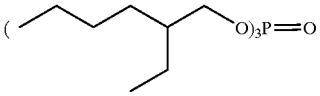 | S-5 |
| 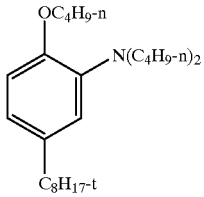 | ST-1 |
| 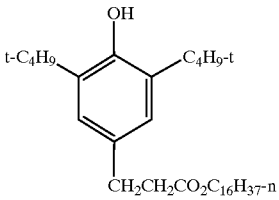 | ST-2 |
| 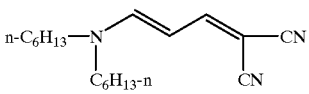 | UV-1 |
| 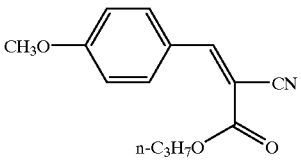 | UV-2 |

TABLE VI-continued

| MULTILAYER FILM STRUCTURE | |
|---|---|
| 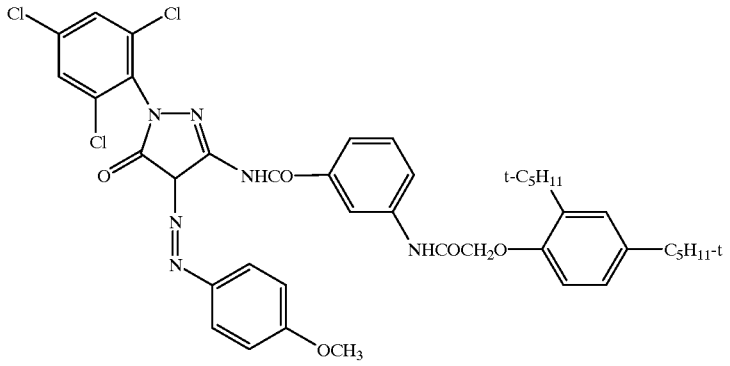 | YD-1 |
| 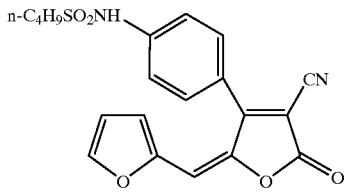 | YD-2 |

The entire contents of the patent applications, patents and other publications referred to in this specification are incorporated herein by reference.

The invention has been described in detail with particular reference to certain preferred embodiments thereof, but it will be understood that variations and modifications can be effected within the spirit and scope of the invention.

What is claimed is:

1. A photographic element, comprising a support bearing at least one silver halide emulsion and at least one benzoylacetanilide yellow dye-forming DIR coupler of structure I, below:

I

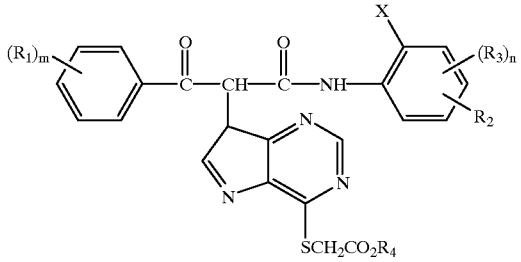

wherein:

each $R_1$ is individually selected from the group consisting of halogen atoms and alkyl and alkoxy groups;

m is 0, 1, 2 or 3;

$R_2$ is selected from the group consisting of halogen atoms and alkoxycarbonyl, aryloxycarbonyl, sulfonamido, sulfamoyl, alkylsulfonyl, arylsulfonyl, sulfonyloxy, acyloxy and cyano groups and each is in the para position or in either meta position relative to the NH group of the anilide;

X is a hydrogen or halogen atom or an alkyl or alkoxy group;

$R_3$ is a halogen atom or an alkyl group and may be in the para position or either meta position relative to the NH group of the anilide;

n is 0 or 1; and $R_4$ is an alkyl group with 3 to 10 carbon atoms or a phenyl group.

2. A photographic element according to claim 1, wherein the benzoylacetanilide yellow dye-forming DIR coupler is coated in the same layer with at least one blue-sensitive silver halide emulsion.

3. A photographic element according to claim 2, wherein the blue-sensitive silver halide emulsion is a tabular grain emulsion.

4. A photographic element according to claim 1, wherein the benzoylacetanilide yellow dye-forming DIR coupler is coated in the same layer with at least one green-sensitive silver halide emulsion.

5. A photographic element according to claim 4, wherein the green-sensitive silver halide emulsion is a tabular grain emulsion.

6. A photographic element according to claim 1, wherein the total number of carbon atoms in all of the $R_1$, $R_2$, $R_3$ and X taken together is at least 6.

7. A photographic element according to claim 6, wherein the the total number of carbon atoms in all of $R_1$, $R_2$, $R_3$ and X taken together is at least 8.

8. A photographic element according to claim 1, wherein m is 1 or 2 and $R_1$ is an alkoxy group.

9. A photographic element according to claim 1, wherein X is a halogen atom.

10. A photographic element according to claim 1, wherein $R_2$ is an alkoxycarbonyl group in the para position relative to X.

11. A photographic element according to claim 1, wherein $R_4$ is an alkyl group with 3 to 6 carbon atoms.

12. A photographic element according to claim 1, wherein the photographic element is a multilayer color negative film.

13. A photographic element according to claim 1, wherein the benzoylacetanilide DIR coupler is coated at a level between 0.004 and 0.60 g/m$^2$.

14. A photographic element according to claim 10, wherein the benzoylacetanlide DIR coupler is coated at a level between 0.010 and 0.25 g/m$^2$.

15. A photographic element according to claim 1, wherein the benzoylacetanilide DIR coupler is selected from the group consisting of:

A1

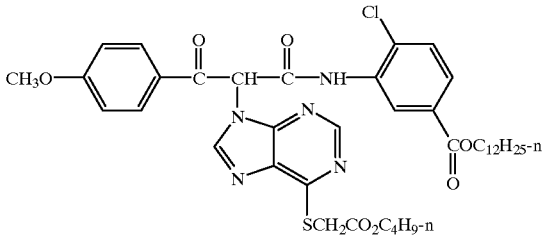

A2

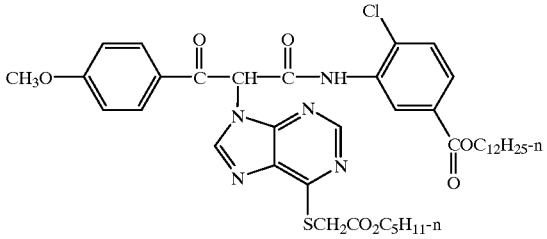

and

A3

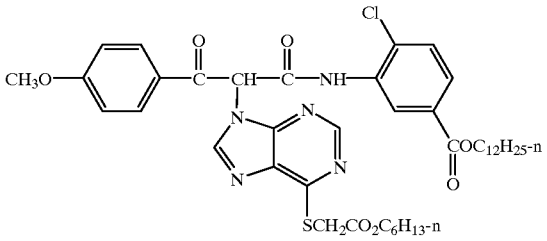

16. A photographic element according to claim 1, wherein the benzoylacetanilide DIR coupler is coated in the same blue-sensitive layer as a yellow dye-forming imaging coupler of structure Y-1 or Y-2, below, or in the same green-sensitive layer with the magenta dye-forming coupler of structure M-1, below:

Y-1

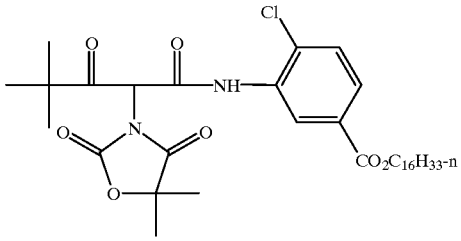

Y-2

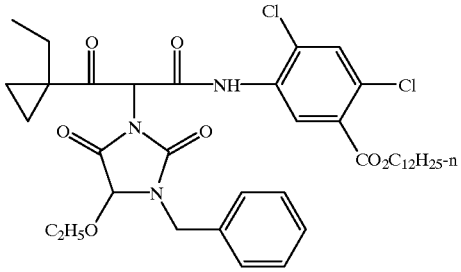

M-1

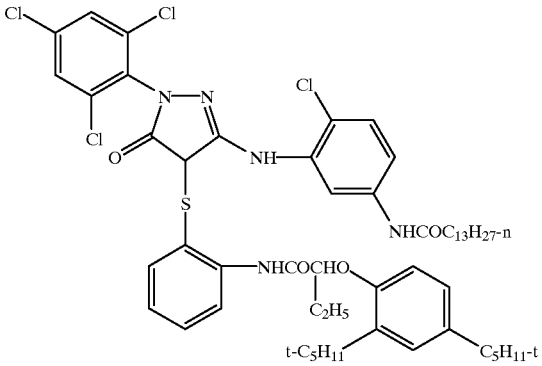

17. A photographic element according to claim 1, wherein the support comprises a magnetic recording layer.

* * * * *

UNITED STATES PATENT AND TRADEMARK OFFICE

CERTIFICATE OF CORRECTION

PATENT NO. : 6,130,031
DATED : October 10, 2000
INVENTOR(S) : Paul B. Merkel et al.

It is certified that error appears in the above-identified patent and that said Letters Patent is hereby corrected as shown below:

Title page,
Delete "BENZOLYLACETANILIDE" and insert -- BENZOYLACETANILIDE --

Abstract,
Delete "structure I" and insert --

I

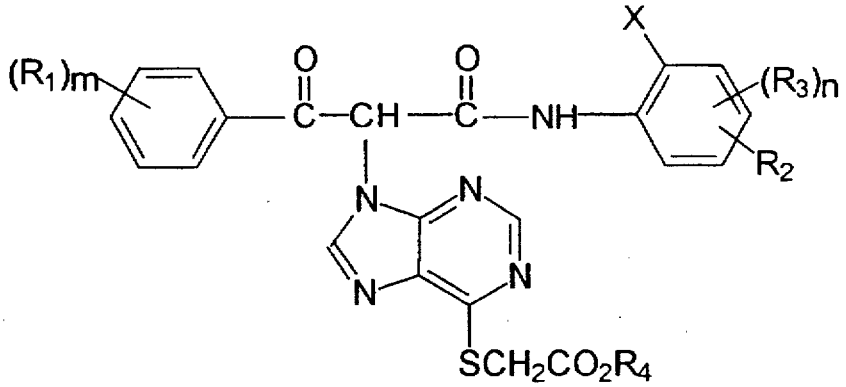

UNITED STATES PATENT AND TRADEMARK OFFICE

CERTIFICATE OF CORRECTION

PATENT NO. : 6,130,031
DATED : October 10, 2000
INVENTOR(S) : Paul B. Merkel et al.

It is certified that error appears in the above-identified patent and that said Letters Patent is hereby corrected as shown below:

Column 1,
Line 2, delete "BENZOLYLACETANILIDE" and insert -- BENZOYLACETANILIDE --

Column 33, claim,
Delete "structure I" and insert -- 1, Structure I

I

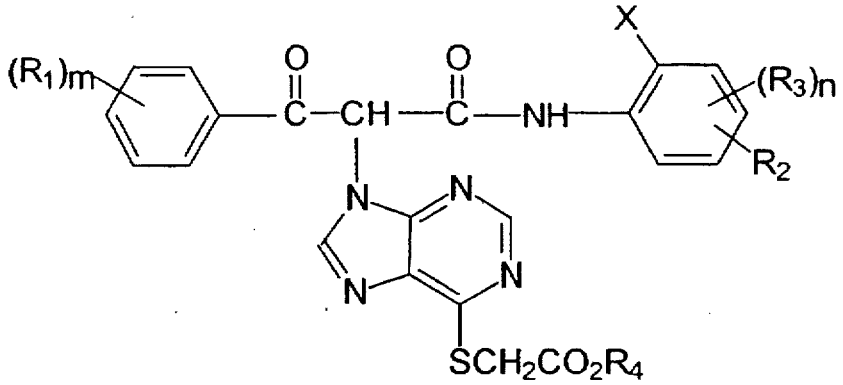

Signed and Sealed this

Twentieth Day of November, 2001

*Attest:*

Nicholas P. Godici

*Attesting Officer*

NICHOLAS P. GODICI
*Acting Director of the United States Patent and Trademark Office*